US006884129B2

(12) United States Patent
Forest et al.

(10) Patent No.: US 6,884,129 B2
(45) Date of Patent: Apr. 26, 2005

(54) JET PUMP BEARING ASSEMBLY

(75) Inventors: Jean-François Forest, Sherbrooke (CA); Gilles Pesant, Palm Bay, FL (US); Patrice Dusablon, Palm Bay, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/223,697

(22) Filed: Aug. 20, 2002

(65) Prior Publication Data

US 2003/0036318 A1 Feb. 20, 2003

Related U.S. Application Data

(60) Provisional application No. 60/313,028, filed on Aug. 20, 2001.

(51) Int. Cl.[7] ..... B63H 11/08
(52) U.S. Cl. ..... 440/38; 440/47
(58) Field of Search ..... 440/38, 40, 41, 440/42, 43, 46, 47; 384/484, 504

(56) References Cited

U.S. PATENT DOCUMENTS

| | | | | | |
|---|---|---|---|---|---|
| 3,640,593 | A | * | 2/1972 | McKee et al. | 384/504 |
| 3,906,886 | A | * | 9/1975 | Elger | 440/38 |
| 4,925,408 | A | | 5/1990 | Webb et al. | 440/38 |
| 4,993,977 | A | * | 2/1991 | Rodler, Jr. | 440/67 |
| 5,152,704 | A | * | 10/1992 | Carlson | 440/38 |
| 5,366,396 | A | * | 11/1994 | Schulze | 440/38 |
| 5,618,213 | A | | 4/1997 | Nanami | 440/38 |
| 5,634,831 | A | * | 6/1997 | Davies et al. | 440/47 |
| 5,704,719 | A | * | 1/1998 | Cook et al. | 384/484 |
| 5,713,769 | A | | 2/1998 | Jones | 440/38 |
| 5,749,757 | A | | 5/1998 | Suganuma | 440/83 |
| 5,759,074 | A | | 6/1998 | Jones | 440/38 |
| 5,871,381 | A | * | 2/1999 | Lin | 440/38 |
| 5,975,966 | A | | 11/1999 | Lin | 440/47 |
| 6,171,158 | B1 | * | 1/2001 | Henmi et al. | 440/38 |
| 6,273,768 | B1 | * | 8/2001 | Blanchard | 440/38 |

OTHER PUBLICATIONS

Brochure, "Sea–Doo Parts Catalog," RX DI 5646/5656, 1999, p. A2, C7 and C8 (Apr. 2000).

* cited by examiner

*Primary Examiner*—S. Joseph Morano
*Assistant Examiner*—Lars A. Olson
(74) *Attorney, Agent, or Firm*—BRP Legal Services

(57) ABSTRACT

The present invention provides a jet pump assembly that includes a rotatable shaft adapted to be operationally coupled to a power source. An impeller is operationally connected to the rotatable shaft. A housing surrounds at least a portion of the rotatable shaft operationally coupled to the impeller. In addition, a single bearing is disposed between the housing and the rotatable shaft, permitting rotation of the rotatable shaft therein. The bearing has at least an inner race operationally coupled to the rotatable shaft and an outer race operationally coupled to the housing. The bearing also includes at least two sets of rolling components disposed, side-by-side between the inner and outer races, permitting rotation of the inner and outer races with respect to one another.

20 Claims, 5 Drawing Sheets

JET PUMP BEARING ASSEMBLY

RELATED APPLICATION

The present application claims priority to U.S. Provisional Application Ser. No. 60/313,028, filed Aug. 20, 2001, the entirety of which is hereby incorporated into the present application by reference.

BACKGROUND OF THE INVENTION

1. Field of the Invention

The present invention relates to the construction for a bearing assembly for a jet pump upon which a boat or similar water-traveling vessel relies for propulsive power.

2. Description of the Related Art

A number of modern watercraft and sport boats rely entirely on jet propulsion technology, such as a jet propulsion drive system, to provide the propulsive force for the vessel.

A jet propulsion drive system (also called a jet pump drive) incorporates an impeller within a pump housing at a position toward the rear of the watercraft. The pump housing is disposed within a inlet duct that extends, at the bottom of the hull, from a point at the rear of the vessel to a point forward of the rear of the vessel. The impeller is operatively connected, through a rotatable shaft, to an engine typically disposed within the hull of the vessel. When rotated by the engine, the impeller draws water through the forward end of the inlet duct and discharges the water, at great speed and pressure, through a nozzle at the rear end (or stern) of the vessel. The force of the water exiting from the nozzle at the stern generates the propulsive force for the vessel.

The impeller is usually affixed to the pump housing through a stator or stator hub, which connects to the pump housing by three or more connecting vanes. The stator or stator hub is a fixed (i.e., non-rotating) element within the pump housing that surrounds the end of the rotatable shaft that extends beyond the rear end of the impeller.

To stabilize the end of the rotating shaft, the stator includes an interior support into which at least two bearings are usually inserted. The outer races of the bearings are affixed to the interior support of the stator and the inner races of the bearings are affixed to the rotatable shaft on which the impeller is disposed.

FIGS. 1–3 illustrate the first embodiment of a jet drive assembly known in the prior art. In this embodiment (as discussed in greater detail below), two roller bearings are disposed an axial distance from one another along the rotating shaft to freely support the rotation of the shaft.

FIG. 4 illustrates a second embodiment of a jet drive assembly known in the prior art. In this embodiment (also as discussed in greater detail below), two ball bearings are disposed an axial distance from one another along the rotating shaft to freely support the rotation of the shaft.

In either prior art jet drive assembly, grease (or other suitable lubricant such as oil) is usually added to the bearings after the jet pump is assembled and before the watercraft is delivered to the customer. Grease (or oil) lubricates the rollers and balls within the bearings to assure a more efficient and smooth operation.

A problem with the prior art, however, is that the rotating shaft, stator, and other associated components must be made sufficiently long to accommodate two bearings disposed a specific axial distance from one another.

In addition, prior art pump bearing assemblies tend to generate noise due to play (e.g., mechanical tolerances) incorporated therein as a result of the construction techniques employed. With the configuration(s) known in the prior art, the bearings tend to wear at a rate that, while acceptable, could be improved.

In addition, due to the tolerances incorporated into the bearings frequently used in the prior art, the watercraft often required an additional anti-rattle system to minimize the noise generated by the pump during operation.

Finally, the bearings in some prior art jet pump assemblies often require re-lubrication after a certain amount of time. In other words, the lubricant (e.g., grease or oil) in the bearings must be replaced or replenished after a certain time period. This is necessary primarily because the bearings in the prior art typically are not completely sealed. Accordingly, the lubrication incorporated into them often leaks out of the bearings over time.

Each of these deficiencies in the prior art, while they do not negatively impact upon the operational or safety characteristics of the watercraft in which the jet pump assembly is installed, ask for improvement.

SUMMARY OF THE INVENTION

The present invention addresses the deficiencies noted in the prior art by providing a jet pump assembly with improved operational characteristics by comparison with prior art jet pump assemblies.

Since the jet pump assembly of the present invention is designed specifically to be incorporated into a watercraft, another aspect of the present invention is to provide a watercraft with improved operational characteristics by comparison with prior art watercraft.

To accomplish these objectives, one aspect of the present invention is the provision of a jet pump assembly that is capable of handling higher axial loads than the jet pump assemblies known in the prior art.

Another aspect of the present invention is the provision of a jet pump assembly that is quieter in its operation by comparison with prior art jet pump assemblies.

Still another aspect of the present invention is the provision of a jet pump assembly where tolerances (e.g., play) in the bearing or the bearings are controlled to a greater extent than in the prior art. In other words, discrepancies and tolerances in the manufacture of the jet pump assembly have a lesser impact on the noise generated by the bearing(s), because the tolerances are more strictly controlled.

A further aspect of the present invention is to provide a jet pump assembly with an increased wear resistance, partly due to the reduction in the amount of play between the various components that comprise the jet pump assembly.

By reducing the amount of play between the components in the jet pump assembly, one aspect of the present invention is to eliminate the need for an anti-rattle system on watercraft that incorporate jet pump assemblies as a power source.

Since the elimination of an anti-rattle system is believed to reduce the stress on the pump cover, another aspect of the present invention is to reduce the stress on the pump cover.

Since the jet pump assembly of the present invention incorporates fewer components than prior art assemblies (e.g., at least due to the elimination of the anti-rattle system), a further aspect of the present invention is a reduction in the overall manufacturing cost of the assembly.

Additionally, an aspect of the present invention is to provide a sealed bearing that requires lubrication to be replaced only when there has been an infiltration by water into the lubrication, thereby reducing the maintenance requirement of the jet pump system into which the bearing is incorporated.

Still another aspect of the present invention is to provide a single bearing for a jet pump assembly that occupies less space than the two bearings used in jet pump assemblies in prior art watercraft.

By reducing the space requirements of the bearing used, one further aspect of the present invention is to provide a smaller pump assembly.

Also, by reducing the space requirements of the bearing used, another aspect of the present invention is to provide a more durable pump assembly.

The present invention accomplishes these objectives, among others, by providing a jet pump assembly that includes a rotatable shaft adapted to be operationally coupled to a power source. An impeller is operationally connected to the rotatable shaft. A housing surrounds at least a portion of the rotatable shaft operationally coupled to the impeller. In addition, a single bearing is disposed between the housing and the rotatable shaft, permitting rotation of the rotatable shaft therein. The bearing has at least an inner race operationally coupled to the rotatable shaft and an outer race operationally coupled to the housing. The bearing also includes at least two sets of rolling components disposed, side-by-side between the inner and outer races, permitting rotation of the inner and outer races with respect to one another.

Other aspects of the present invention will become apparent from the drawings and the detailed description herein.

BRIEF DESCRIPTION OF THE DRAWINGS

Throughout the drawings of the present invention, where appropriate, like elements and structures are referred to by the same reference numerals, in which.

DESCRIPTION OF THE PREFERRED EMBODIMENTS

Figure 1:
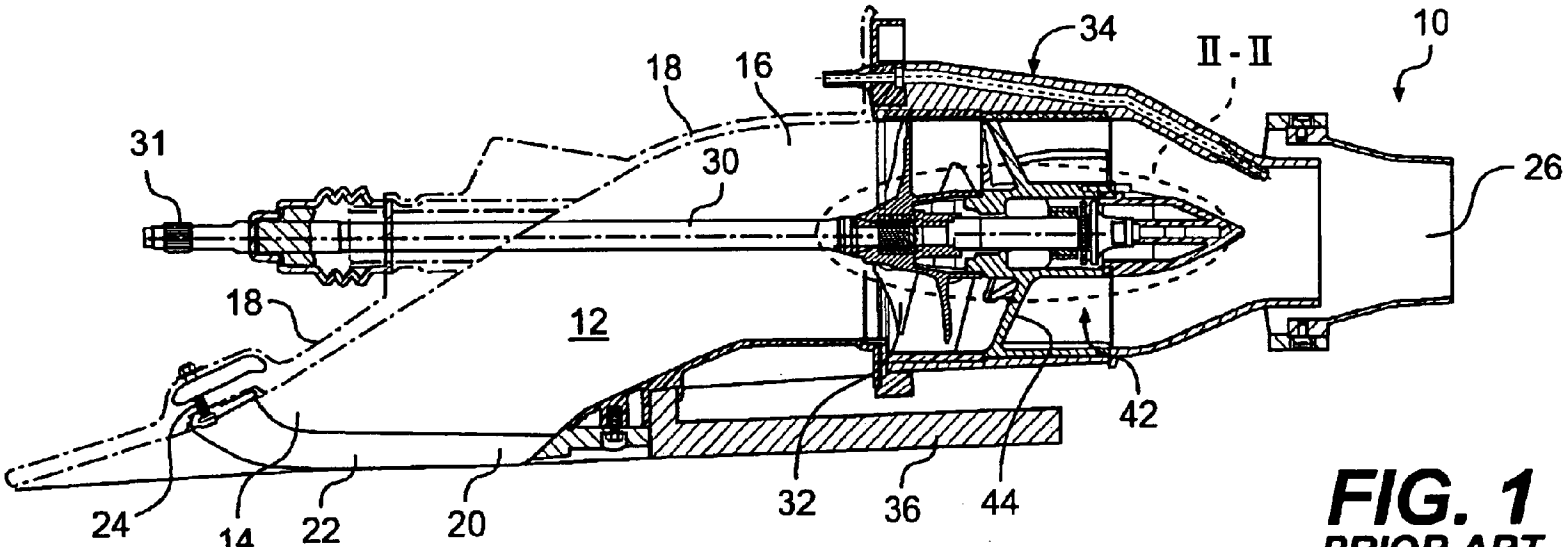
FIG. 1 PRIOR ART
FIG. 1 is a side view cross-sectional illustration of a prior art jet pump assembly, showing the inlet duct and the pump housing disposed therein.
Figure 6:
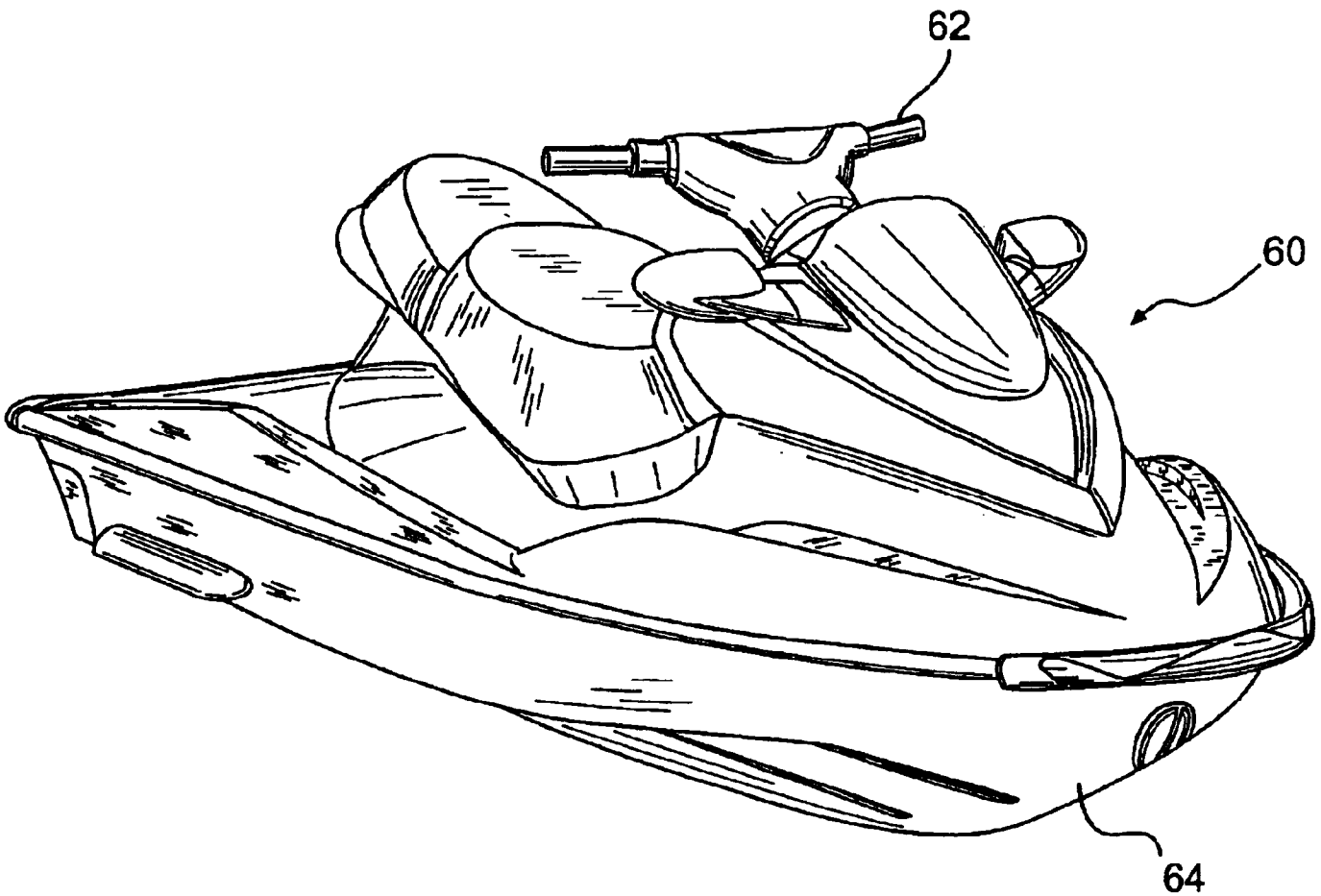
FIG. 6 is a perspective illustration of the type of watercraft into which the pump bearing assembly of the present invention may be incorporated.

One example of a typical jet pump drive 10 that may be found in the prior art is illustrated in FIG. 1. The jet pump drive 10 may be incorporated into any type of watercraft or boat regardless of its size, style, design, or configuration. In particular, the jet pump drive 10 is of the type that has been designed for use in personal watercraft. One typical example of a personal watercraft 60 is illustrated in FIG. 6. Since the appearance and design of the vessel is not relevant to the present invention, the appearance of the vessel is not illustrated in the drawings showing the details of the jet pump drive 10.

The jet pump drive 10 typically is disposed at the bottom of the stern of the vessel in which it is incorporated. The jet pump drive 10 includes a inlet duct 12, which extends from an inlet 14 at the forward end of the inlet duct 12 to an outlet 16 at the rear of the inlet duct 12.

The inlet duct 12 preferably is formed as part of the hull 18 of the vessel. As would be understood by those skilled in the art, however, the inlet duct 12 need not be formed as part of the hull 18. Instead, the inlet duct 12 could be formed as part of an integral pump assembly that could be manufactured separately and incorporated into the hull 18 as a single unit.

The inlet duct 12 is bounded at its forward-most end by a grate 20. The grate 20 incorporates a plurality of grate ribs 22 that are attached to the hull on an interior surface 24 of the inlet duct 12. The grate ribs 22 form a lattice structure for the grate 20 to discourage ingestion of large objects by the jet pump drive 10. Typically, the grate ribs 22 are made from a corrosion-resistant metal, although any suitable corrosion-resistant material such as plastic may be used.

In the usual arrangement, the inlet duct 12 is bounded at its rearmost end by a directional nozzle 26 (otherwise known as a steering nozzle). The steering nozzle 26 is responsible for redirecting the flow of water from the inlet duct 12. To do this, the steering nozzle 26 is usually connected to the helm 62 of the vessel 60 through several cables (not shown) or any other suitable type of control mechanism (using servo motors, for example). When the operator changes the direction of the helm 62, the steering nozzle 26, which is mounted at the rear of the vessel 60 so that it may pivot between port and starboard sides of the vessel 60, also changes direction. This redirects the flow of high pressure water from the inlet duct 12 to permit steering of the vessel 60.

In some cases, the steering nozzle 26 also may be disposed to pivot vertically (at least to a limited degree) in addition to being able to pivot horizontally. If the thrust of the steering nozzle 26 is adjustable in the vertical direction, this is believed to provide the driver with greater control over the operational characteristics of the vessel 60. In particular, vertical directional control over the steering nozzle 26 is believed to limit (under certain circumstances) the vessel's tendency to porpoise at certain speeds. "Porpoising" refer to a vessel's up and down movement that mimics the jumping motion of a porpoise in the water.

In the typical prior art example, the jet pump drive 10 is powered by an engine (not shown), which is operatively connected to a drive shaft 30. The drive shaft 30, in turn, connects to an impeller shaft 38. It is preferred that the output shaft from the engine and the drive shaft 30 be connected at a connecting junction, via a spline 31. Alternatively, the two shafts may be operatively connected to one another by any suitable connector, including a gearbox, that permits rotational motion to be transferred to the drive shaft 30 from the output shaft.

Regardless of the specific construction of the drive shaft and the engine output shaft, in prior art watercraft, the drive shaft 30 extends through the hull 18 to an impeller 32, which is positioned within a pump housing 34. The pump housing 34 is a portion of the inlet duct 12 that surrounds the impeller 32. It is most easily defined as the portion of the inlet duct 12 that is disposed above the ride plate 36, which is the surface on which the vessel rides when the vessel reaches a predetermined speed.

Figure 2:
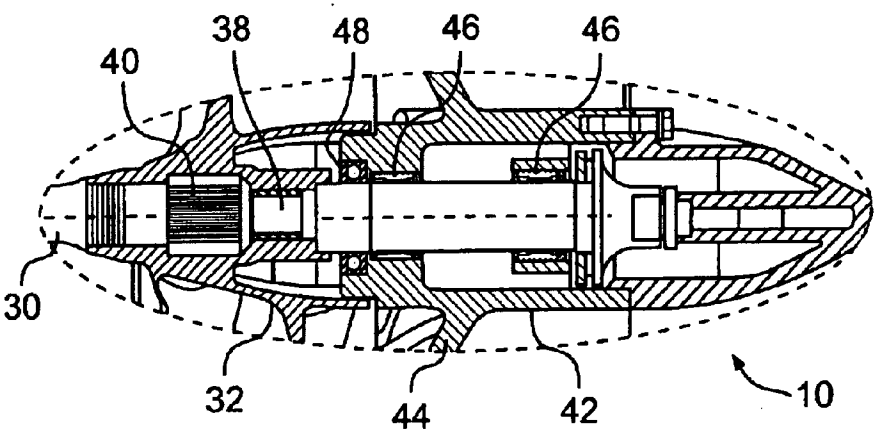
FIG. 2 PRIOR ART
FIG. 2 is an enlarged cross-sectional illustration of the portion of the impeller assembly illustrated in FIG. 1 that is surrounded by the circle labeled II—II.

As may be understood more fully from FIG. 2, which illustrates in detail a portion of the jet pump drive 10 shown in FIG. 1, the drive shaft 30 is connected to an impeller shaft 38 through a spline 40. The impeller shaft 38 extends rearwardly from the impeller 32 into a stator or stator hub 42, which is fixedly mounted to the interior of the inlet duct 12 (and, therefore, does not rotate with respect to the impeller 32).

The stator 42 typically connects to the sides of the inlet duct 12 through one or more stator vanes 44, which may be shaped to assist in directing the flow of water through the inlet duct 12. The stator vanes 44 may be connected to the interior surface 24 of the inlet duct 12 by any suitable connector, such as adhesive, fasteners (such as bolts), or a press-fit.

The stator 42 surrounds and supports the impeller shaft 38, which rotates therein. Without stator 42, the impeller shaft 38 would be free to move within the inlet duct 12 and would likely significantly reduce impeller 32 performance, because the rearward-most end of the impeller shaft 38 would be permitted to vibrate freely within the pump housing 34. To permit the impeller 32 to rotate within the stator 42, one or more bearings 46, 47 are disposed between the impeller shaft 38 and the stator 42.

Figure 3:
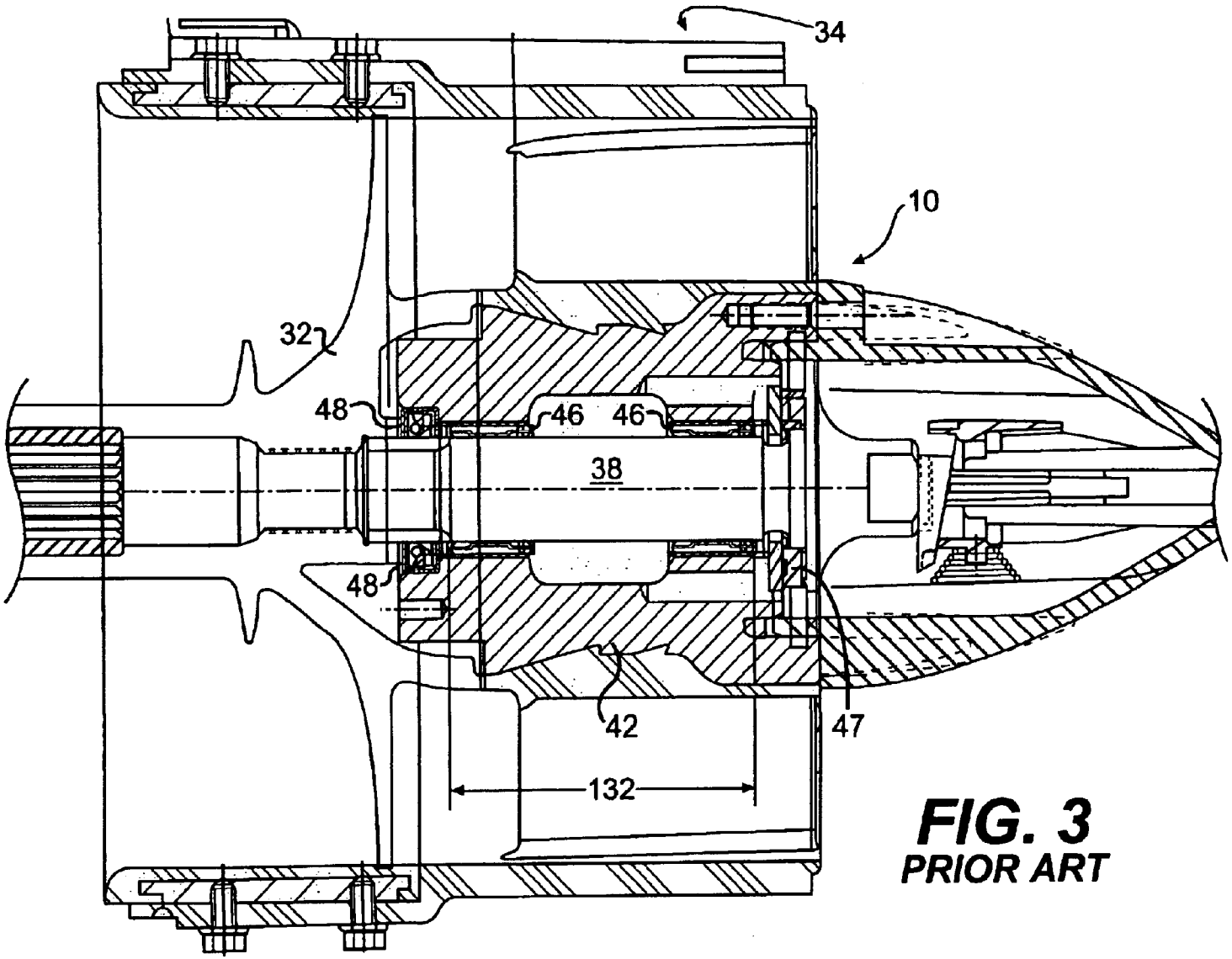
FIG. 3 PRIOR ART
FIG. 3 is another enlarged, cross-sectional illustration of a portion of the impeller assembly shown in FIG. 1.

As illustrated in FIGS. 2 and 3, three such bearings 46, 47 are disposed within the stator 42. The roller bearings 46 may incorporate balls or rollers between the races to permit the inner and outer races to move with respect to one another. In the embodiment illustrated in FIGS. 2 and 3, the bearings 46 are roller bearings (meaning that the inner and outer races sandwich a plurality of cylindrical rollers between them to facilitate rotation). In addition, the bearing 47 is a thrust bearing. While it is contemplated that the present invention incorporates one or more roller bearings 46 that include inner and outer races, those skilled in the art would appreciate that the inner race is not required to practice the present invention. Therefore, it is contemplated that the present invention also encompasses a variant where the inner races are not included in the roller bearings 46.

In the typical example, the roller bearings 46 are filled with a lubricant, such as grease or oil, after the impeller 32 and the stator 42 are assembled together. To minimize damage of the roller bearings 46 by salt water (or any other water in which the vessel is intended to operate), one or more lip seals 48 are disposed between the impeller shaft 38 and the stator 42. The lip seal 48 also discourages the water from rinsing away the grease or oil within the roller bearings 46.

FIG. 3 illustrates at least a portion of the construction of the jet pump assembly 10 in greater detail. In this particular drawing, the positional relationship between the stator 42, the impeller 32, the roller bearings 46, the thrust bearing 47, and the lip seal 48 is more readily apparent than in FIG. 2.

Figure 4:
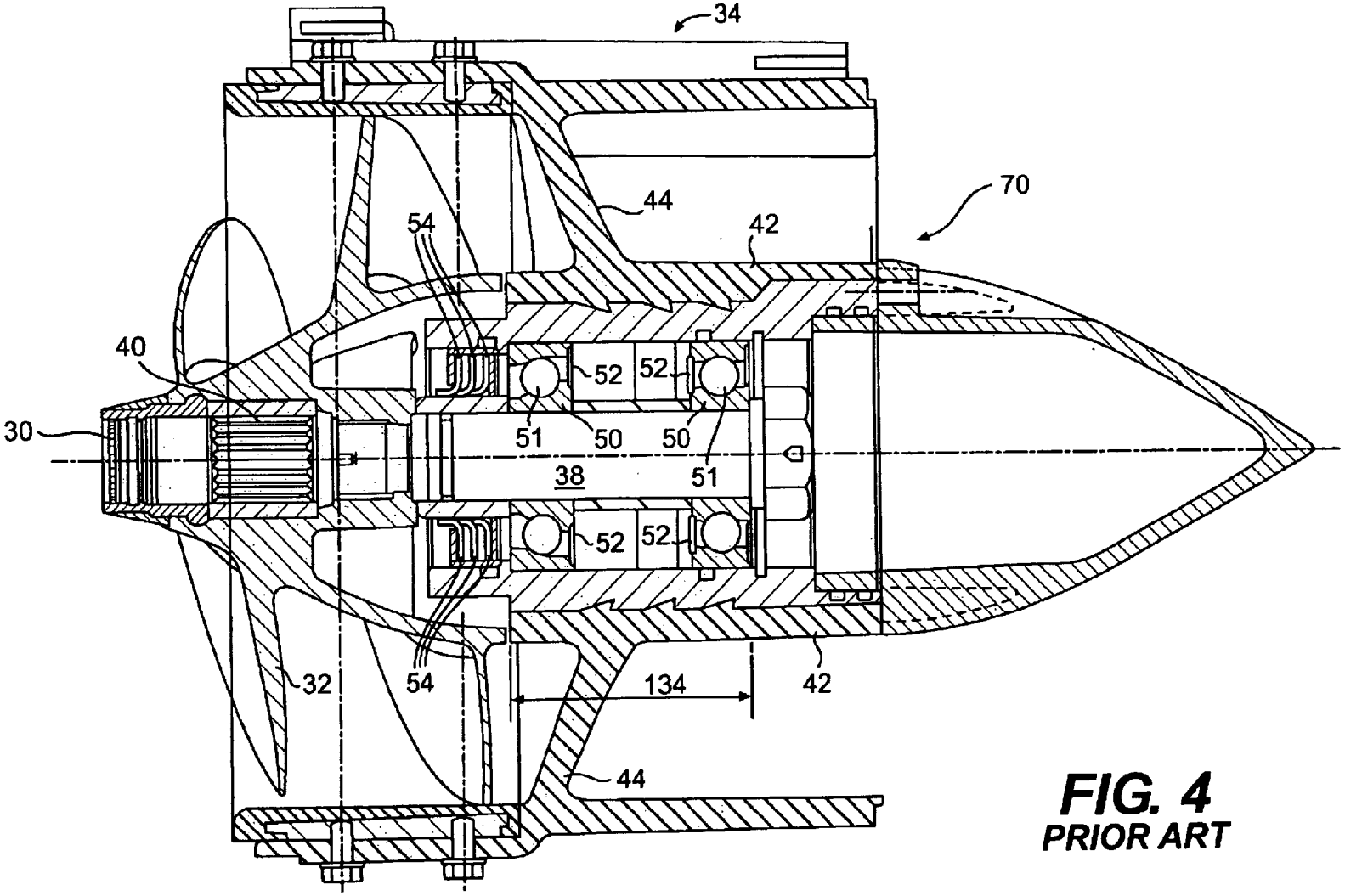
FIG. 4 PRIOR ART
FIG. 4 is a cross-sectional illustration of a second embodiment of a construction of the jet pump assembly found in the prior art.

While roller bearings 46 are typically used in jet pump assemblies 10 in the prior art, the prior art also teaches that ball bearings 50 may be used instead, as shown in FIG. 4. Ball bearings 50 differ from roller bearings 46 in that they trap a plurality of spherical balls 51 between the inner and outer races to facilitate rotation of one race with respect to the other. The ball bearings 50 may be filled with grease or other lubricant (such as oil), just as with the roller bearings 46. In addition, the ball bearings 50 may be provided with sealed ends 52 to prevent the leakage of lubricant from the interior of the ball bearings 50.

As in the example illustrated in FIGS. 1–3, the jet pump assembly 70 illustrated in FIG. 4 includes one or more lip seals 54 to prevent water from interfering with the operation of the roller bearings 50.

Each of FIGS. 1–4 illustrate two embodiments of known, prior art pump bearing assemblies 10, 70. While these prior art pump bearing assemblies 10, 70 have been entirely adequate to the task that they have been designed to perform, the pump bearing assembly 100 of the present invention, which is illustrated in FIG. 5, offers a significant number of advantages thereover.

The pump bearing assembly 100 of the present invention is designed to be fitted into the hull 64 of a watercraft 60 in the same manner as the jet pump assemblies 10 illustrated in FIGS. 1–4. Therefore, an illustration and a description of the elements standard in the construction of a watercraft 60 with a jet pump drive 10 is not repeated here.

The pump bearing assembly 100 of the present invention includes an impeller 102 that is operatively connected to an impeller shaft 104. The impeller shaft 104, in turn, is operatively connected, via a spline 106, to a drive shaft 108. The impeller shaft 104, spline 106, and drive shaft 108 are all operatively connected to the engine's output shaft (not shown) so that rotational power from the engine may be transmitted to the impeller 102.

Figure 5:
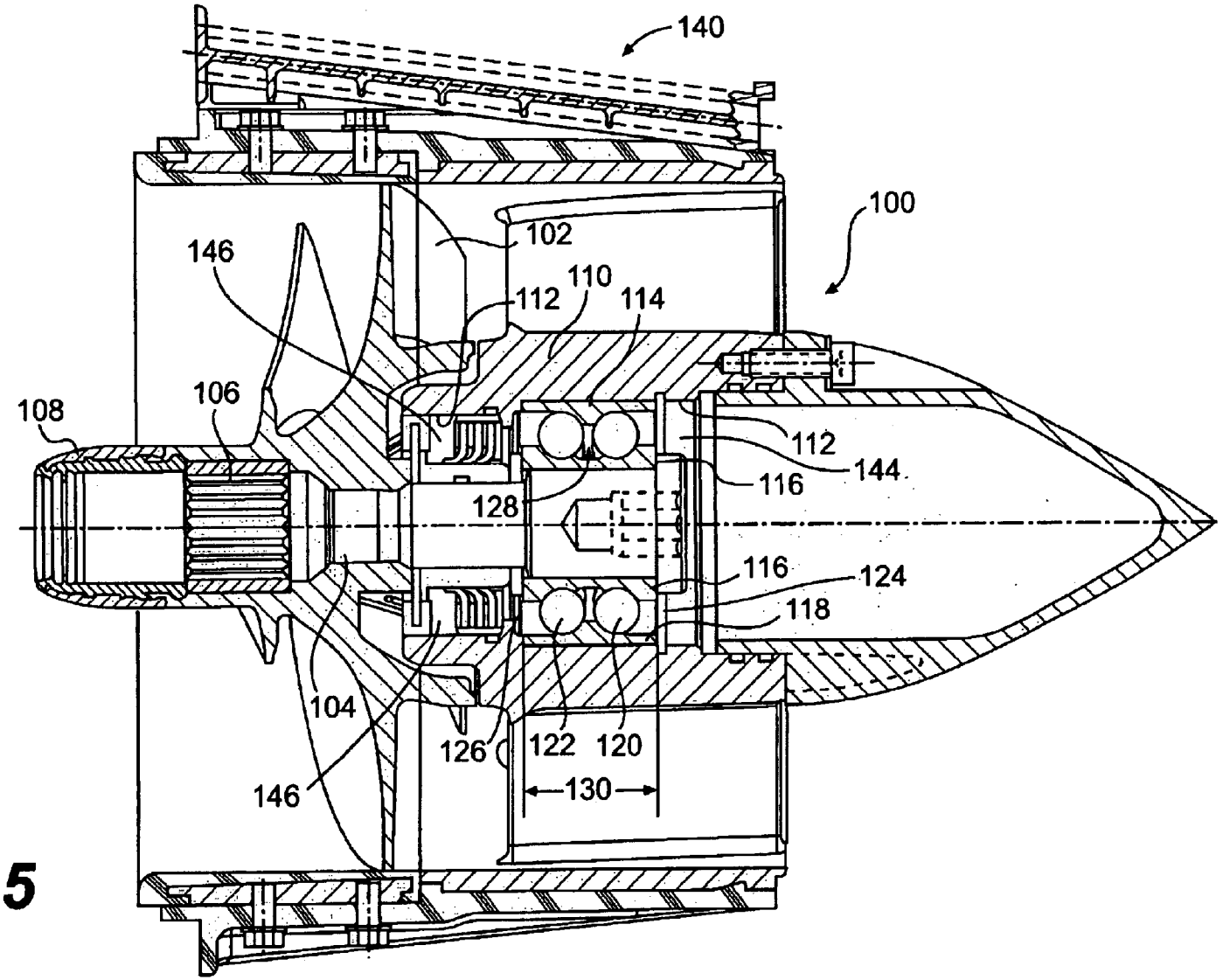
FIG. 5 is a cross-sectional illustration of the jet pump assembly of the present invention.

The jet pump bearing assembly 100 is contained within a housing 140, as shown in FIG. 5. The housing 140 is disposed between the hull 142 and the ride plate (not shown in FIG. 5). In other words, the housing 140 is a structure that surrounds the jet pump assembly 100 between the hull 142 and the ride plate.

The impeller 102, impeller shaft 104, spline 106, and drive shaft 108 are all preferably made of a corrosion-resistant metal such as stainless steel. Those skilled in the art, however, would readily recognize that any other suitable material may be used in place of stainless steel without departing from the scope of the present invention.

It should be noted that while an engine shaft, a drive shaft 108, and an impeller shaft 104 are preferred for the construction of the jet drive assembly 100 of the present invention, such a combination of elements is not required to practice the present invention. Instead, a greater or a fewer number of shafts may be employed to achieve the same result without deviating from the scope of the present invention. Specifically, the drive shaft 108 and the impeller shaft 104 could be formed as an integral unit (a single shaft). Alternatively, the drive shaft 108 and the impeller shaft 104 may be constructed as a single shaft. The particular construction is not critical, as would be understood by those skilled in the art. Since all that is required is a shaft that has the capability of transferring rotational motion to the impeller 102, the three shafts preferred for the construction of the present invention are referred to collectively as the "rotatable shaft."

The rotatable shaft is operatively connected to the impeller 102 and a portion of the rotatable shaft extends toward the stern of the vessel from the impeller 102. Since the portion of the rotatable shaft that extends from the stern end of the impeller 102 is the impeller shaft 104 in the preferred embodiment of the present invention, reference will be made to the impeller shaft 104 (it being understood the name of the shaft is irrelevant).

The impeller shaft 104 extends from the stern end of the impeller 102 into the housing 110 of the stator. The stator housing (hereinafter referred to as the stator hub) 110 at least partially surrounds the impeller shaft 104. A bearing 114 extends between the impeller shaft 104 and the stator hub 110.

The bearing includes an inner race 116 and an outer race 118. The inner race 116 is fixedly mounted to the outer surface of the impeller shaft 104. The outer race 118 is fixedly mounted to the inner surface 112 of the stator hub 110. As illustrated in FIG. 5, the inner race 116 and the outer race 118 are unitary components. However, as would be appreciated by those skilled in the art, either or both races 116, 118 may be divided into more than one portion. For example, the inner race 116 may comprise two separate races to support the bearings 120, 122 therein.

In one embodiment of the present invention, the bearing 114 includes two sets of balls 120, 122 that are sandwiched between the inner race 116 and the outer race 118 to permit the two races to rotate with respect to one another. While two sets of spherical balls 120, 122 may be included in the bearing 114, those skilled in the art would readily recognize that the bearing could be manufactured with any suitable type of rolling component, including cylindrically-shaped rollers or conically-shaped rollers. Other types of rolling components also may be used without deviating from the scope of the present invention.

In addition, the bearing 114 preferably includes two sets of rolling components therein. While two sets are preferred, it is contemplated that more than two sets of rolling components may be positioned between the inner race 116 and the outer race 118 without deviating from the scope of the present invention.

The bearing 114 preferably is bounded on either side by a seal 124, 126. The seals 124, 126 prevent grease (or other suitable lubricant) that may be provided in the interior cavity 128 from leaking out and reducing the operational characteristics of the bearing 114. In an alternative embodiment, grease, oil, or other suitable lubricant may be injected in the cavities 144, 146 at either end of the bearing 114.

In the preferred embodiment of the jet pump assembly 100 of the present invention, the bearing 114, preferably is pre-manufactured and assembled as a separate component. Still more preferably, the bearing 114 is pre-assembled and the grease (or other suitable lubricant) is pre-loaded into the cavity 128.

When the bearing 114 is manufactured as a separate component, several benefits are realized. First, the engineered tolerances within the bearing 114 may be controlled such that there is little play between the components. In addition, as a pre-manufactured component, the seals 124, 126 that prevent leakage of grease from the cavity 128 within the bearing 114 generally are expected to last for the lifetime of the bearing 114. It is expected that the grease will need to be replaced only if there has been an infiltration of water into the grease. In addition, when the bearing 114 is manufactured as a separate component, it becomes an "off-the-shelf" part that can be quickly installed in the watercraft 60. Also, as a pre-manufactured component, the bearing 114 is pre-loaded with grease or oil, eliminating the need to add the grease or oil during manufacture (a step that was required in the jet pump assemblies 10, 70 of the prior art). In addition, maintenance costs of the jet pump assembly 100 can be reduced, because lubricant need not be added to the cavity 128 in the bearing 114 during its lifetime.

The bearing 114 is designed to have a reduced axial dimension 130 as compared with the axial dimensions 132, 134 of the bearings in the two prior art examples. FIGS. 3 and 4 are illustrative. As illustrated, length 132 (roller bearing embodiment, FIG. 3)>length 134 (ball bearing embodiment, FIG. 4)>length 130 (present invention, FIG. 5). Since the axial length 130 of the bearing 114 is reduced over those of the prior art, the pump assembly 100 may be made more compact by comparison with the jet pump assemblies 10, 70 of the prior art.

The overall construction of the jet pump assembly 100 of the present invention offers several additional advantages over the prior art.

In particular, the jet pump bearing assembly 100 is referred to as a single bearing unit because it incorporates the single bearing 114. The new bearing 114 can take higher axial loads than the prior art bearings 46, 50 because of its axial configuration, among other reasons.

The bearing 114 may be an angular contact bearing. As would be appreciated by those skilled in the art, angular contact bearings are those where the rollers contact the inner and outer races at an angle. This differs from the typical bearing design where the contact between the rollers and the inner and outer races is perpendicular to the axis about which the bearing rotates.

The two races 116, 118 may be manufactured together at the same time. As a result, the tolerances within the bearing 114 may be much closer than the bearings 46, 50 of the prior art.

Alternatively, the bearing 114 may have a ball-type construction. If so, it is preferred that the ball-type construction of the bearing 114 provide a deep-groove design. As would be appreciated by those skilled in the art, a deep groove bearing is one where the grooves in which the rollers are seated are deeper than a standard bearing. As a result, where the rollers are ball-bearings, the rollers contact the inner and outer races along arcuate surfaces. Due to this construction, deep-groove bearings are able to tolerate both radial and axial loads with minimal or no radial or axial slippage.

Because the bearing tolerances are reduced, there is less wear on the elements of the jet pump assembly 100, which means that it will enjoy a longer operational lifetime. In addition, the improved tolerances mean that the jet pump assembly 100 does not need to be provided with an anti-rattle system, which reduces the overall complexity and cost of the system. Moreover, without an anti-rattle system, stress on the pump cover is reduced.

Since the play in bearing 114 is smaller than the bearings 46, 50 in the prior art and since the tolerances in the bearing 114 are smaller, clearance between the impeller 102 and the hub 110 also can be reduced. This increases performance.

Since the bearing 114 is pre-manufactured with lubricant in the cavity 128, and since the bearing is provided with seals 124, 126, lubricant does not need to be replaced in the cavity 128. In other words, the grease or oil in the cavity 128 remain in the cavity 128 for its operational lifetime unless there has been an infiltration by water, which would necessitate replacement of the grease or oil. This simplifies construction and maintenance.

The description of the preferred embodiments of the present invention is not meant to limit the scope of protection provided by the claims appended hereto. Instead, the foregoing description is meant to be as broad as possible and is meant to encompass all of the embodiments that are equivalent to the one described.

What is claimed is:

1. A jet pump assembly, comprising:

a rotatable shaft adapted to be operationally coupled to a power source;

an impeller operationally connected to the rotatable shaft;

a housing surrounding at least a portion of the rotatable shaft operationally coupled to the impeller; and only one single bearing unit;

the bearing unit being disposed between the housing and the rotatable shaft, permitting rotation of the rotatable shaft therein, the bearing unit comprising at least two sets of rolling components disposed, side-by-side.

2. The jet pump assembly according to claim 1, wherein the bearing unit further comprises:

an inner race operationally coupled to one of either the housing or the rotatable shaft; and an outer race operationally coupled to one of either the housing or the rotatable shaft, wherein the rolling components are disposed between the inner and outer races.

3. The jet pump assembly of claim 2, wherein the inner and outer races form an angular contact bearing.

4. The jet pump assembly of claim 1, wherein the rotatable shaft comprises:

at least one or more of an engine output shaft, a drive shaft, and an impeller shaft.

5. The jet pump assembly of claim 1, wherein the bearing has at least one seal.

6. The jet pump assembly of claim 1, wherein the bearing further comprises:

lubricant disposed within a cavity formed between the inner and outer races.

7. The jet pump assembly of claim 1, wherein the at least one seal comprises three lip seals.

8. The jet pump assembly of claim 1, wherein the at least two sets of roiling components comprises exactly two sets of roiling components.

9. The jet pump assembly of claim 1, wherein the housing is a stator hub.

10. The jet pump assembly of claim 1, wherein the bearing unit is a deep groove bearing.

11. A watercraft, comprising:

a hull;

a helm disposed on the hull;

a steerable nozzle disposed at the rear of the hull, operatively connected to the helm; and a jet pump assembly, comprising a rotatable shaft adapted to be operationally coupled to a power source, an impeller operationally connected to the rotatable shaft, a housing surrounding at least a portion of the rotatable shaft operationally coupled to the impeller, and only one single bearing unit;

the bearing unit disposed between the housing and the rotatable shaft, permitting rotation of the rotatable shaft therein, the bearing unit comprising at least two sets of rolling components disposed, side-by-side.

12. The watercraft according to claim 11, wherein the bearing comprises:

an inner race operationally coupled to one of either the housing or the rotatable shaft; and an outer race operationally coupled to one of either the housing or the rotatable shaft, wherein the rolling components are disposed between the inner and outer races.

13. The watercraft of claim 12, wherein the inner and outer races are an angular contact bearing.

14. The watercraft of claim 11, wherein the rotatable shaft comprises:

at least one or more of an engine output shaft, a drive shaft, and an impeller shaft.

15. The watercraft of claim 11, wherein the bearing has at least one seal.

16. The watercraft of claim 11, wherein the bearing further comprises:

lubricant disposed within a cavity formed between the inner and outer races.

17. The watercraft of claim 11, wherein the at least one seal comprises three lip seals.

18. The watercraft of claim 11, wherein the at least two sets of rolling components comprises exactly two sets of rolling components.

19. The watercraft of claim 11, wherein the housing is a stator hub.

20. The watercraft of claim 11, wherein the bearing unit is a deep groove bearing.

* * * * *